United States Patent [19]

Tomas

[11] 4,415,361

[45] Nov. 15, 1983

[54] IRON BASED ALLOY

[75] Inventor: Pantcho Tomas, Randwick, Australia

[73] Assignee: British Gas Corporation, London, England

[21] Appl. No.: 435,945

[22] Filed: Oct. 22, 1982

[30] Foreign Application Priority Data

Nov. 2, 1981 [GB] United Kingdom ..... 8132912

[51] Int. Cl.[3] ..... C22C 38/06

[52] U.S. Cl. ..... 75/124; 75/123 R; 75/123 CB; 75/123 J

[58] Field of Search ..... 75/124, 123 R, 123 CB, 75/123 J; 148/35

[56] References Cited

FOREIGN PATENT DOCUMENTS 53-57118 5/1978 Japan ..... 75/124

53-42019 11/1978 Japan ..... 75/124

*Primary Examiner*—L. Dewayne Rutledge

*Assistant Examiner*—Debbie Yee

*Attorney, Agent, or Firm*—Larson and Taylor

[57] ABSTRACT

An iron based alloy comprises between 6 and 20% by weight niobium and between 5 and 10% by weight aluminium, the balance being iron and incidental impurities. Preferably the alloy comprises between 7 and 17% by weight niobium and suitably between 5 and 6% by weight aluminium.

The alloy is suitable as a component in a coal gasifier eg. as a gas inlet or outlet tube or as a structural support member because of its high resistance to corrosive attack by sulphur-bearing gas such as hydrogen sulphide.

Typical alloy compositions comprise 7.6% niobium, 5.3% aluminium, balance iron and incidental impurities and 16.6% niobium, 5.0% aluminium balance iron and incidental impurities.

3 Claims, No Drawings

IRON BASED ALLOY

The present invention relates to an alloy which is iron-based and which is particularly though not exclusively for use as a sulphidation resistant alloy in certain components in a coal gasifier.

In order to increase the efficiency of the production of gas from coal, that is, to produce both more gas from a given quantity of coal and from lower grade coal, it is necessary to operate the gasification process at higher temperatures and pressures than in the past. Elevating the temperature and pressure of operation and utilizing lower grade coal results in an increase in the sulphur content in the gas so produced in the form of hydrogen sulphide.

The sulphur-bearing gas so produced is highly corrosive since both its quantity and chemical activity are increased and consequently there is an acceleration of the sulphidation attack on certain components in the gasifier, particularly those components conventionally made of steel, particularly stainless steel such as the tubular gas inlet and outlet linings and vessel supports.

Certain conventionally available materials such as pure molybdenum are known to be very resistant to attack by sulphur but these materials are generally prohibitively expensive.

It is therefore an object of the present invention to provide an alloy which has a sulphidation resistance superior to that of the materials conventionally used in gasifier components and moreover which is cheaper than the more expensive of the known sulphidation resistant materials such as pure molybdenum.

According therefore to the present invention an iron-based alloy is provided, the alloy comprising between 6 and 20% by weight niobium and between 5 and 10% by weight aluminium, the balance being iron and incidental impurities.

Preferably the alloy comprises between 7 and 17% by weight niobium and suitably between 5 and 6% by weight aluminium.

The invention will now be described by way of example only with reference to Tables I and II.

Two samples of the alloy were made up (Fenbal 7, Fenbal 17 in Table I) of the general composition shown in Table I. The alloy samples Fenbal 7 and Fenbal 17 were produced as 1 kilogram melts in an argon are melting furnace. Both melts were then cast as 25 mm diameter ingots and Fenbal 7 was further hot extruded at 1100°-1150° to a 12.5 mm diameter bar.

Samples of the Fenbal 17 ingot and the Fenbal 7 bar were then subjected to a simulated highly sulphidising atmosphere to determine their sulphidation resistance. The atmosphere was a gas comprising hydrogen plus 1 volume % hydrogen sulphide. Two tests were performed on each sample at 700° C. and 800° C. respectively for a duration of 9 hours per test. At the same time similar tests were performed on a number of standard materials. The results are shown in Table I in which the gain in weight of each sample is shown for each test. Low weight gain is consistent with high resistance to sulphidation. It is clear from Table I that the Fenbal 7 and 17 alloys are the most sulphidation resistant of the samples tested and in fact Fenbal 17 is just as resistant as the 99.97% by weight molybdenum sample.

It is believed that this resistance to sulphidation corrosion is due to the formation of a highly protective scale formed on the Fenbal alloys in the early stages of the test. This is attributable to the mutual additions of both aluminium and niobium. Moreover, the binary addition of niobium to iron at low concentrations was shown not to be as beneficial. It is also well documented throughout the scientific literature that small binary additions of aluminium to pure iron do not provide resistance comparable to the ternary iron-niobium-aluminium alloys.

In addition 200 hour duration isothermal oxidation tests were performed on Fenbal 7 at 600°, 700°, 800°, 900°, 1000° and 1150° C. It was found that the Fenbal 7 alloy is very oxidation resistant up to a temperature of about 1000° C. It was found that the alloy forms a protective $Al_2O_3$ scale upon initial oxidation. The applicants believe that the Fenbal 7 alloy may be extremely resistant to both sulphidation and oxidation in mixed gas environments typical of direct coal gas conversion, and coal and oil gasification at temperatures of between 600° and 950° C.

The main impurity elements found in the Fenbal alloys are carbon, manganese, phosphorus, sulphur, silicon, yttrium and hafnium. These elements should be present in the concentrations shown in Table II.

TABLE 1

Alloys within the present study and the resultant weight gains after 9 hours duration in hydrogen plus 1 volume % hydrogen sulphide.

| | Major Alloying Elements (wt %); balance Fe | | | | | | | | Final Weight Gain mgm/cm$^2$ | |
|---|---|---|---|---|---|---|---|---|---|---|
| Designation | C | Mn | Ni | Cr | Mo | Al | Nb | Others | 700° C. ($pS_2 = 3 \times 10^{-9}$ Atm) | 800° C. ($2 \times 10^{-8}$ Atm) |
| Electrolytic Fe | | | | | | | | | 55.7 | 78.1 |
| 304 SS⊕ | 0.08 | 1.5 | 9.2 | 18.2 | 0.3 | — | — | | 37.4 | |
| 316 SS⊕ | 0.04 | 1.5+ | 10.2 | 16.8 | 2.4 | — | — | | 42.5 | |
| 310 SS⊕ | 0.05 | 1.5+ | 20.5 | 24.7 | n.a. | — | — | | 36.0 | |
| Femnal 30 | 0.8 | 30.4 | — | — | — | 7.6 | — | | 1.5 | 8.8 |
| MA956E* | — | — | — | 20.0 | — | 4.5 | — | 0.5Ti; 0.5$Y_2O_3$ | 7.2 | 27.6 |
| Fe-10Mo | <0.01 | | | | 10.1 | | | | 41.8 | |
| Fe-20Mo | " | | | | 20.2 | | | | 28.2 | 67.7 |
| Fe-40Mo | " | | | | 39.4 | | | | 27.2 | 43.8 |
| Fe-70Mo | " | | | | 70+ | | | | 4.2 | |
| Fe-90Mo | " | | | | 90+ | | | | 3.1 | 5.7 |
| 99.97Mo | " | | | | | | | | <0.5 | <0.5 |
| Fe-10Nb | " | | | | | | 10.7 | | 39.4 | |
| Fe-20Nb | " | | | | | | 18.8 | | 34.1 | 57.7 |
| Fenbal 7 | " | | | | | 5.3 | 7.6 | | 0.9 | 0.5 |

TABLE 1-continued

| Alloys within the present study and the resultant weight gains after 9 hours duration in hydrogen plus 1 volume % hydrogen sulphide. | | | | | | | | | | |
|---|---|---|---|---|---|---|---|---|---|---|
| | Major Alloying Elements (wt %); balance Fe | | | | | | | | Final Weight Gain mgm/cm$^2$ | |
| Designation | C | Mn | Ni | Cr | Mo | Al | Nb | Others | 700° C. ($pS_2 = 3 \times 10^{-9}$ Atm) | 800° C. ($2 \times 10^{-8}$ Atm) |
| Fenbal 17 | " | | | | | 5.0 | 16.6 | | 0.2 | 0.2 |

*Proprietary alloy produced by Messrs. Henry Wiggin & Co Ltd.
+Nominal composition only.
⊕SS = Stainless Steel.

TABLE II

| Impurity Element | Weight % in Fenbal Alloy |
|---|---|
| Carbon | <0.09 preferably <0.05 |
| Manganese | <0.49 |
| Phosphorus | <0.05 |
| Sulphur | <0.05 |
| Silicon | <0.25 |
| Yttrium | <0.7 |
| Hafnium | <1.0 |

The total content of yttrium and hafnium should not exceed 1.5% by weight.

I claim:

1. An iron-based alloy consisting essentially of between 7 and 20% by weight niobium and between 5 and 10% by weight aluminium the balance being iron and incidental impurities.

2. An alloy as claimed in claim 1 in which the alloy comprises between 7 and 17% by weight niobium.

3. An alloy as claimed in claim 1 or claim 2 in which the alloy comprises between 5 and 6% by weight aluminium.

* * * * *